US005259502A

United States Patent [19]

Chan

[11] Patent Number: 5,259,502

[45] Date of Patent: Nov. 9, 1993

[54] TOOL CASE

[76] Inventor: Po C. Chan, P.O. Box 82-144, Taipei, Taiwan

[21] Appl. No.: 52,798

[22] Filed: Apr. 26, 1993

[51] Int. Cl.[5] ..... B65D 85/28

[52] U.S. Cl. ..... 206/372; 206/45; 206/373; 220/4.27; 211/129

[58] Field of Search ..... 206/45, 45.15, 45.17, 206/372, 373; 220/4.26, 4.27, 23.83; 211/128, 129

[56] References Cited

U.S. PATENT DOCUMENTS

| | | | |
|---|---|---|---|
| 1,027,701 | 5/1912 | Deming | 211/129 |
| 1,090,592 | 3/1914 | Betham | 206/45 |
| 1,383,259 | 6/1921 | Jordan | 206/45 |
| 1,992,630 | 2/1935 | Piperoux | 206/373 |
| 2,914,189 | 11/1959 | Bishop et al. | 211/129 |
| 3,161,315 | 12/1964 | Braun | 220/4.26 |
| 4,807,773 | 2/1989 | Tsai | 220/4.27 |
| 4,817,483 | 3/1989 | Du Grenier et al. | 211/129 |

*Primary Examiner*—David T. Fidei
*Attorney, Agent, or Firm*—Alfred Lei

[57] ABSTRACT

This invention relates to a tool case and in particular to one including a base container having two adjacent corners each formed with a hole, a first intermediate container disposed on the base container and having a corner with a hole and an adjacent corner with a slot, a rod inserted into the hole of one of the two adjacent corners of the base container and the hole of the first intermediate container, a second intermediate container disposed on the first intermediate container and having a hole at a corner, a cover disposed on the second intermediate container and having a L-shaped hole at a corner, and a L-shaped axle engaged with the hole of another one of the two adjacent corners of the base container, the slot of the first intermediate container, and the L-shaped hole of the cover.

2 Claims, 5 Drawing Sheets

PRIOR ART

TOOL CASE

BACKGROUND OF THE INVENTION

It has been found that the conventional tool case 50 (see FIGS. 5 and 5A) is composed of four containers 51 which are joined together by a connecting plate 52. However, such tool case 50 is integrally formed and the container 51 cannot be replaced with a new one in case of being broken. Furthermore, such tool case 50 will occupy a relatively large space when opened thereby making it inconvenient to use.

Therefore, it is an object of the present invention to provide an improved tool case which may obviate and mitigate the above-mentioned drawbacks.

SUMMARY OF THE INVENTION

This invention relates to an improved and novel tool case.

It is the primary object of the present invention to provide a tool case which is easy to open.

It is another object of the present invention to provide a tool case which is convenient to use.

It is still another object of the present invention to provide a tool case which is simple in construction.

It is still another object of the present invention to provide a tool case which is compact in size.

It is a further object of the present invention to provide a tool case which is portable and economic to produce.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
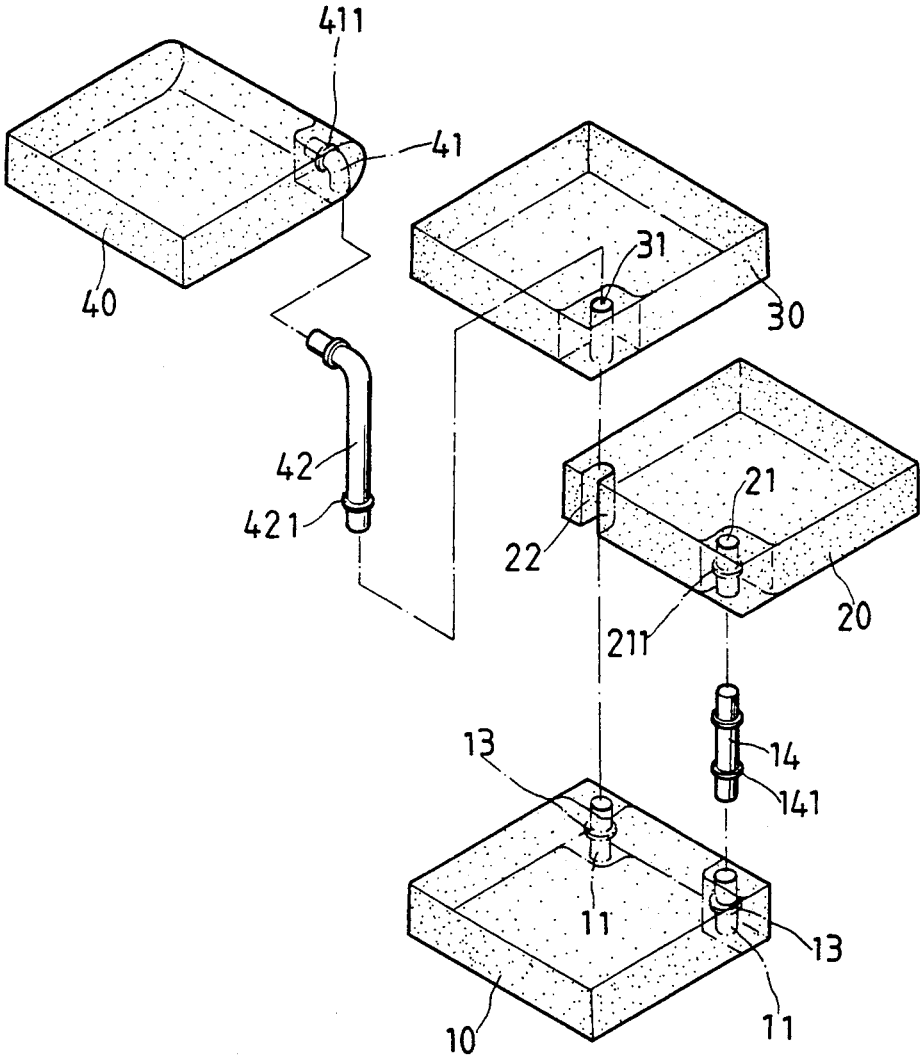
FIG. 1 is an exploded view of the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
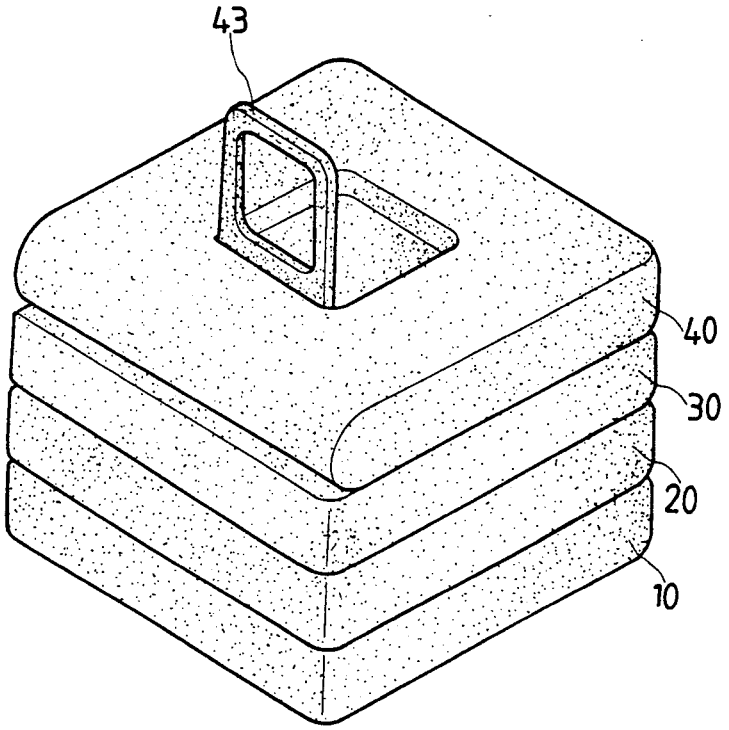
FIG. 2 is a perspective view of the present invention.
Figure 3:
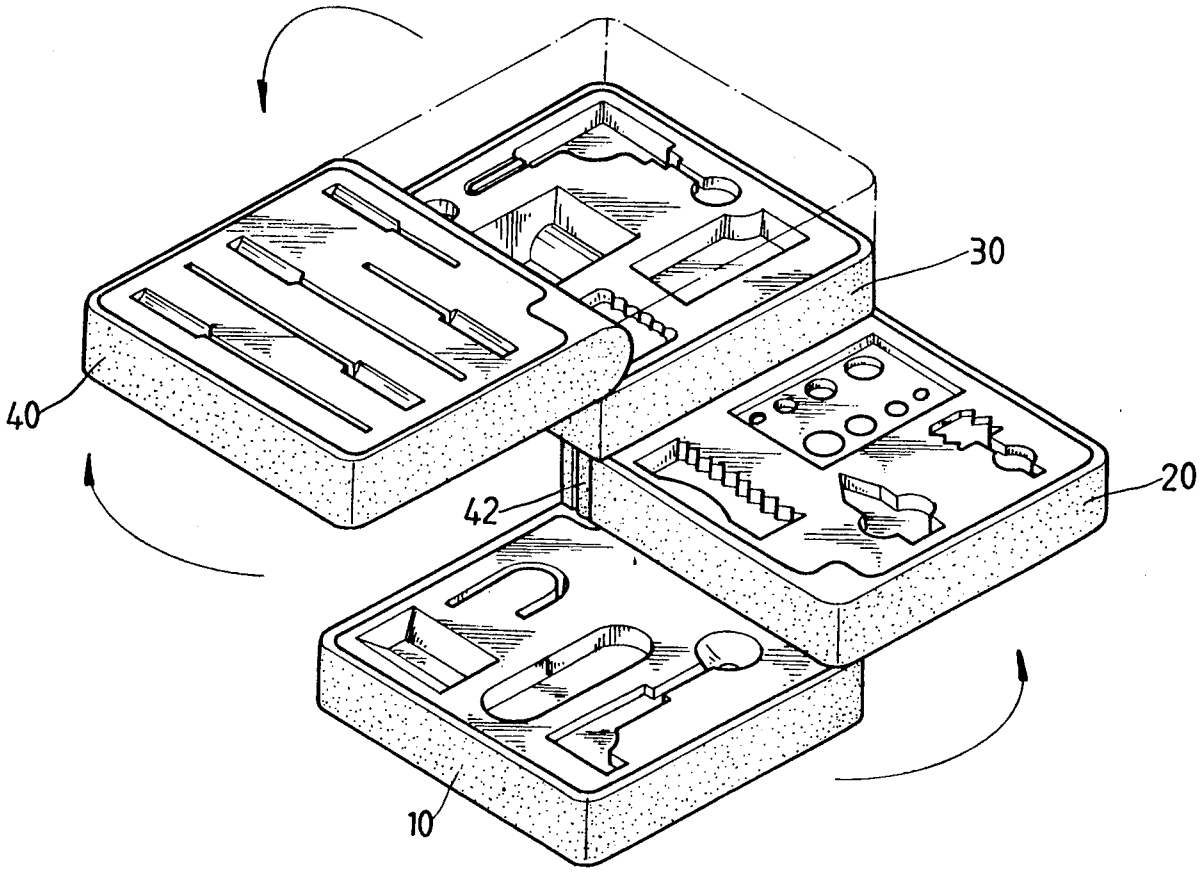
FIG. 3 shows the open state of the present invention.
Figure 4:
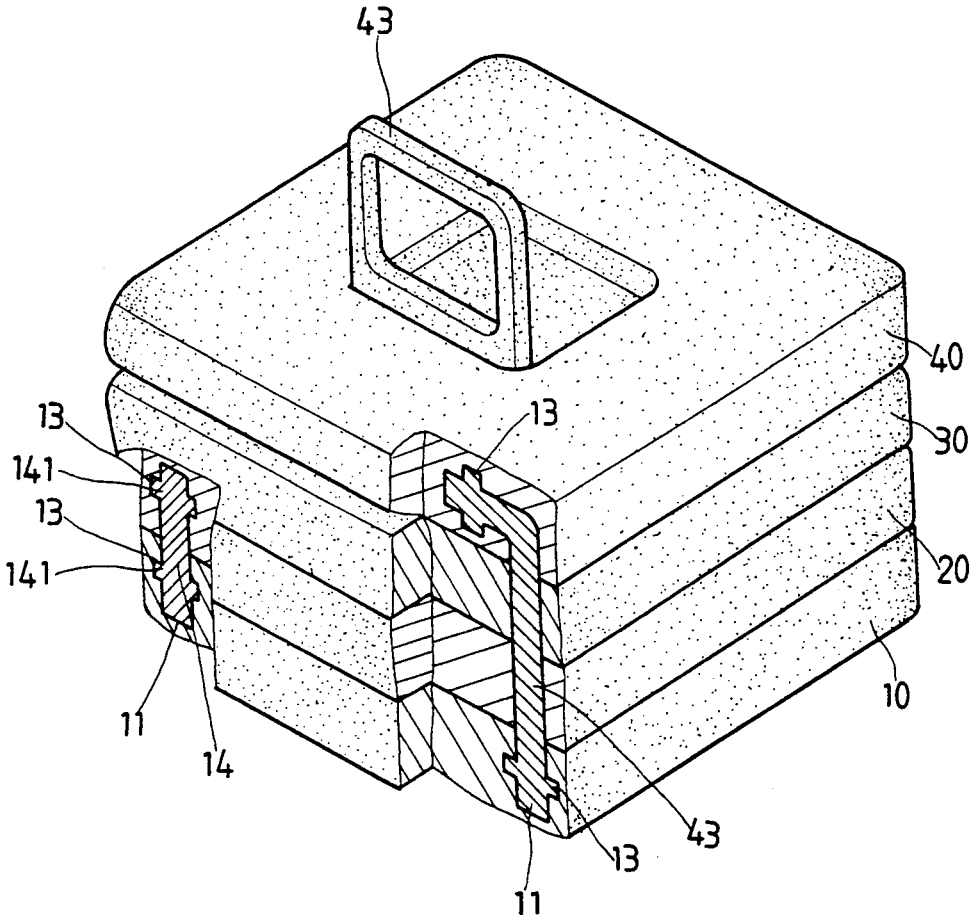
FIG. 4 is a sectional view of the present invention.
Figures 5, 5A:
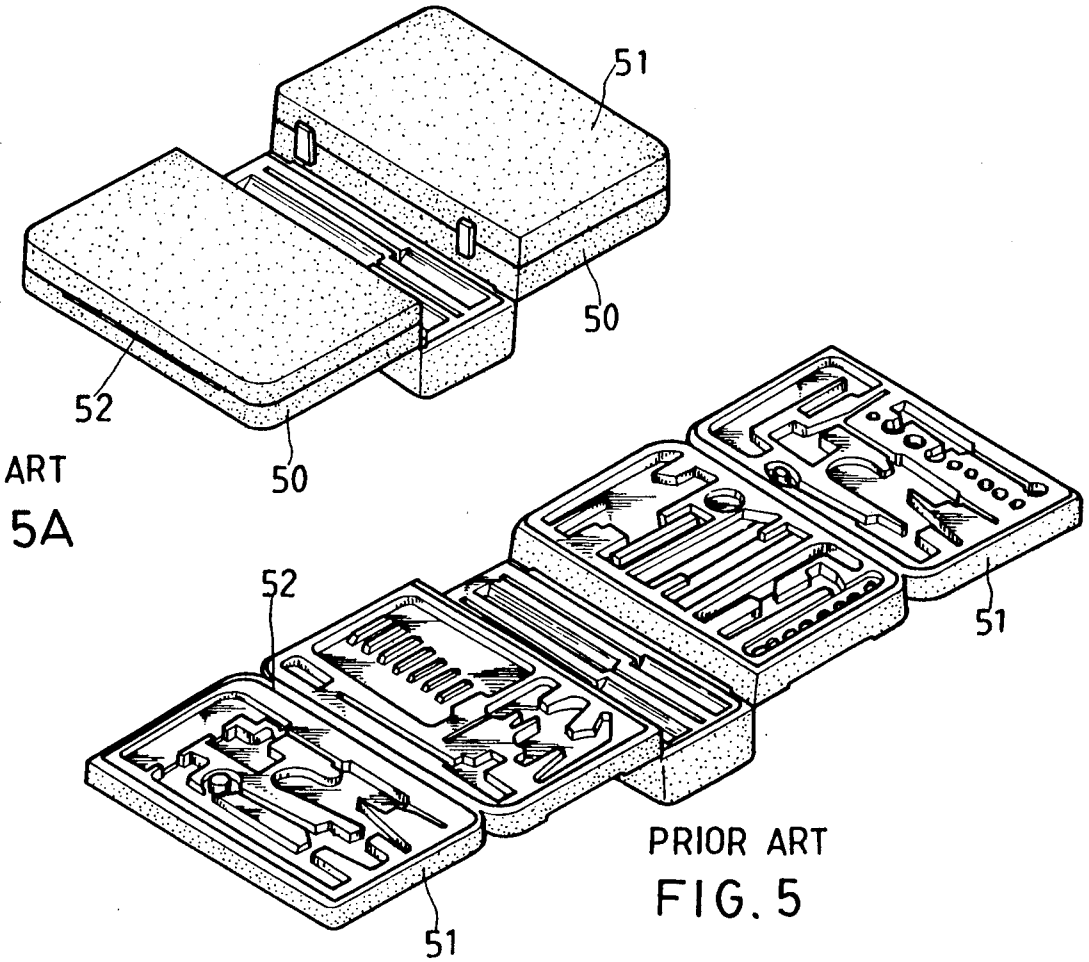
FIG. 5A PRIOR ART
FIGS. 5 and 5A show a prior art tool case.

With reference to the drawings and in particular to FIGS. 1, 2, 3 and 4 thereof, the tool case according to the present invention mainly comprises a base container 10 two adjacent corners of which are formed with a hole 11 and an annular groove 13 at the intermediate portion of the hole 11. A rod 14 with an annular projection 141 at both ends is force-fitted into the hole 11 of the base container 10, with its lower annular projection 141 engaged with the annular groove 13 of the base container 10.

On the base container 10 there is a first intermediate container 20 which is provided at an corner with a hole 21 and an annular groove 212 at the intermediate portion of the hole 21 and at an adjacent corner with a slot 22. The first intermediate container 20 is connected with the base container 10 by engaging the upper part of the rod 14 with the hole 21 of the first intermediate container 20.

A second intermediate container 30 is mounted on the first intermediate container 20 and has a hole 30 at one of its corner.

A L-shaped axle 14 is inserted into the hole 31 of the second intermediate container 30, the slot 22 of the first intermediate container 20, and the hole 11 at another corner of the base container 10, with its annular projection 421 engaged with the annular groove 13 of the hole 11. Hence, the first and second intermediate containers 20 and 30 may be turned about the axle 14.

A cover 40 having a L-shaped hole 41 with an annular groove 411 is mounted on the second intermediate container 30, with its L-shaped hole 41 and annular groove 411 engaged with the upper end and corresponding annular projection 421 of the axle 42. Thus, the cover 40 may be turned over with respect to the axle 42.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A tool case comprising:

a base container having two adjacent corners each formed with a hole;

a first intermediate container disposed on said base container and having a corner with a hole and an adjacent corner with a slot;

a rod inserted into the hole of one of the two adjacent corners of said base container and the hole of said first intermediate container;

a second intermediate container disposed on said first intermediate container and having a hole at a corner;

a cover disposed on said second intermediate container and having a L-shaped hole at a corner; and a L-shaped axle engaged with the hole of another one of the two adjacent corners of said base container, the slot of said first intermediate container, and the L-shaped hole of said cover.

2. The tool case as claimed in claim 1, wherein said rod and said L-shaped axle have an annular projections at the upper end and the lower end, and said base container, said first intermediate container and said cover are provided with a corresponding annular groove.

* * * * *